US005232279A

United States Patent [19]

Boberg et al.

[11] Patent Number: 5,232,279

[45] Date of Patent: Aug. 3, 1993

[54] APPARATUS FOR MAKING INSULATING CELLULAR CONCRETE

[76] Inventors: Walter Boberg; M. Kathleen Boberg, both of P.O. Box 373, Loma Linda, Calif. 92354

[21] Appl. No.: 782,532

[22] Filed: Oct. 25, 1991

[51] Int. Cl.[5] ..... B28C 5/46

[52] U.S. Cl. ..... 366/22; 366/64

[58] Field of Search ..... 366/14, 15, 64, 65, 366/66, 279, 309, 310, 311, 312, 313, 144, 7, 4, 601

[56] References Cited

U.S. PATENT DOCUMENTS

| | | | |
|---|---|---|---|
| 447,366 | 3/1891 | Scharf | 366/14 |
| 701,465 | 6/1902 | Cavin . | |
| 2,618,576 | 11/1952 | Brown | 366/14 |
| 2,633,340 | 3/1953 | Zagray et al. | 259/169 |
| 2,989,291 | 6/1961 | Bedner | 259/174 |
| 3,888,468 | 6/1975 | Albin | 259/171 |
| 3,995,867 | 12/1976 | Katzenberger | 259/148 |
| 4,057,608 | 11/1977 | Hashimoto et al. | 264/42 |
| 4,396,291 | 8/1983 | Simmonds | 366/601 |
| 4,637,731 | 1/1987 | Dahlin | 366/64 |
| 4,707,140 | 11/1987 | Mohrlang | 366/311 |
| 4,789,244 | 12/1988 | Dunton et al. | 366/12 |
| 4,896,968 | 1/1990 | Baillie | 366/140 |
| 4,966,463 | 10/1990 | Hihara et al. | 366/3 |

FOREIGN PATENT DOCUMENTS 444911 6/1983 Sweden .

*Primary Examiner*—Robert W. Jenkins

*Attorney, Agent, or Firm*—Fulwider, Patton, Lee & Utecht

[57] ABSTRACT

An apparatus for making insulating cellular concrete consists of one or multiple mixing tanks. The multiple tanks are connected in tandom to a common pressure fed pump (6) via a valved (8) manifold (10). These simplified apparati can be trailer mounted (12), allowing for easy transport. A special blade assembly (14), water heating device (16), and check valve (20) allow for versatility, improved quality of concrete, and economy.

7 Claims, 3 Drawing Sheets

APPARATUS FOR MAKING INSULATING CELLULAR CONCRETE

BACKGROUND 1. 1. Field of the Invention

This invention relates to an apparatus for making light weight insulating cellular concrete by whipping air into a cement-emulsion mixture.

2. Discussion of Prior Art

Heretofore, light weight cellular concrete has commonly been made by whipping a special emulsion into foam and adding this foam to a cement slurry. This is accomplished by mixing cement, water, and sometimes sand or other aggregate, in a concrete mixer. The foam is prepared in a special apparatus in which a foaming agent mixes with air and water forming many air bubbles. When this is added to the cement slurry, the air bubbles trapped in the emulsion remain suspended in the cement mixture. After hardening, the trapped air makes the concrete lighter and more insulating than standard concrete. This process requires a minimum of two tanks, one for mixing the foam and one for the cement slurry. When the foam is injected into the cement slurry, it is difficult to get the foam mixed evenly throughout the cement slurry without defoaming the bubble mixture. When homogeneity is achieved, the mixture is heavier than the product made by a Swedish patented machine (B(21) 8303524-6) described below, and the invention apparatus.

When the concrete from the previous art machine U.S. Pat. No. 4,966,463 is cured, with a density of 38.4 lb/ft$^3$, the allowable bending stress (flexural strength) is 38.3 psi. Whereas the concrete from the invention apparatus has a density of 18.7 lb/ft$^3$ and an allowable bending stress of 34.8 psi. This is a 51% reduction in weight with only a 9% reduction in strength.

The above mentioned Swedish machine is a single batch machine which mixes the foam and the cement slurry in the same tank. The system is controlled with a control unit in the form of a micro computer which automatically adds the raw materials at he proper time and in the proper amounts. The complete setup is sufficiently large to require a dedicated truck or a truck and crane to move it from site to site. This Swedish machine is exceptionally expensive due to the automated control unit. This, together with the expense of moving the equipment from site to site, limits its usefulness. In addition, it is not easy to go in and reset the micro computer to make it possible to use a different emulsion.

This machine tends to overfoam the mixture causing the concrete to have less strength. Using the same formula and process for both, the present invention apparatus produced concrete with the compressive strength of 220 psi as compared to 87 psi for the prior art Swedish design. Both tests were done by reliable engineering labs. Lastly, this machine can only make one batch of cellular concrete at a time, restricting its use to small jobs.

One problem that is common to all of the prior art machines is that they can only be used at temperatures above freezing due to the lack of a water preheater.

OBJECTS AND ADVANTAGES

Accordingly, several objects and advantages of the present invention are:

(a) to provide an apparatus which makes a higher quality cellular concrete and yet be much more economical than previously developed machines;

(b) to provide an apparatus which makes a higher quality cellular concrete and be much more versatile than previously developed machines as explained in items c, d, f, and h.

(c) to provide an apparatus which makes a higher quality cellular concrete that can be easily trailered by a standard pickup truck or its equivalent;

(d) to provide an apparatus which makes a higher quality cellular concrete which allows for continuous pouring;

(e) to provide an apparatus which makes a higher quality cellular concrete without overfoaming, which causes loss of strength;

(f) to provide an apparatus which can easily be used for any emulsion or cement formulation in making cellular concrete;

(g) to provide an apparatus which allows one to sample the consistency of the foam during mixing, allowing for variation in water hardness, which may change mixing times;

(h) to provide an apparatus which includes a water preheating system, allowing for year round use in colder climates.

Further objects and advantages will become apparent from a consideration of the ensuing description and drawings.

DRAWING FIGURES

REFERENCE NUMERALS IN DRAWINGS

| | |
|---|---|
| 2 top loading opening | 10 manifold |
| 4 multiple tanks | 12 trailer platform |
| 6 pneumatic diaphram pump | 14 blade assembly |
| 8 on-off valves | 16 water heater |
| 18 hose screw mount | 22 timer switch |
| 20 bleeder valve | 24 switch panel |

DESCRIPTION

Figure 1:
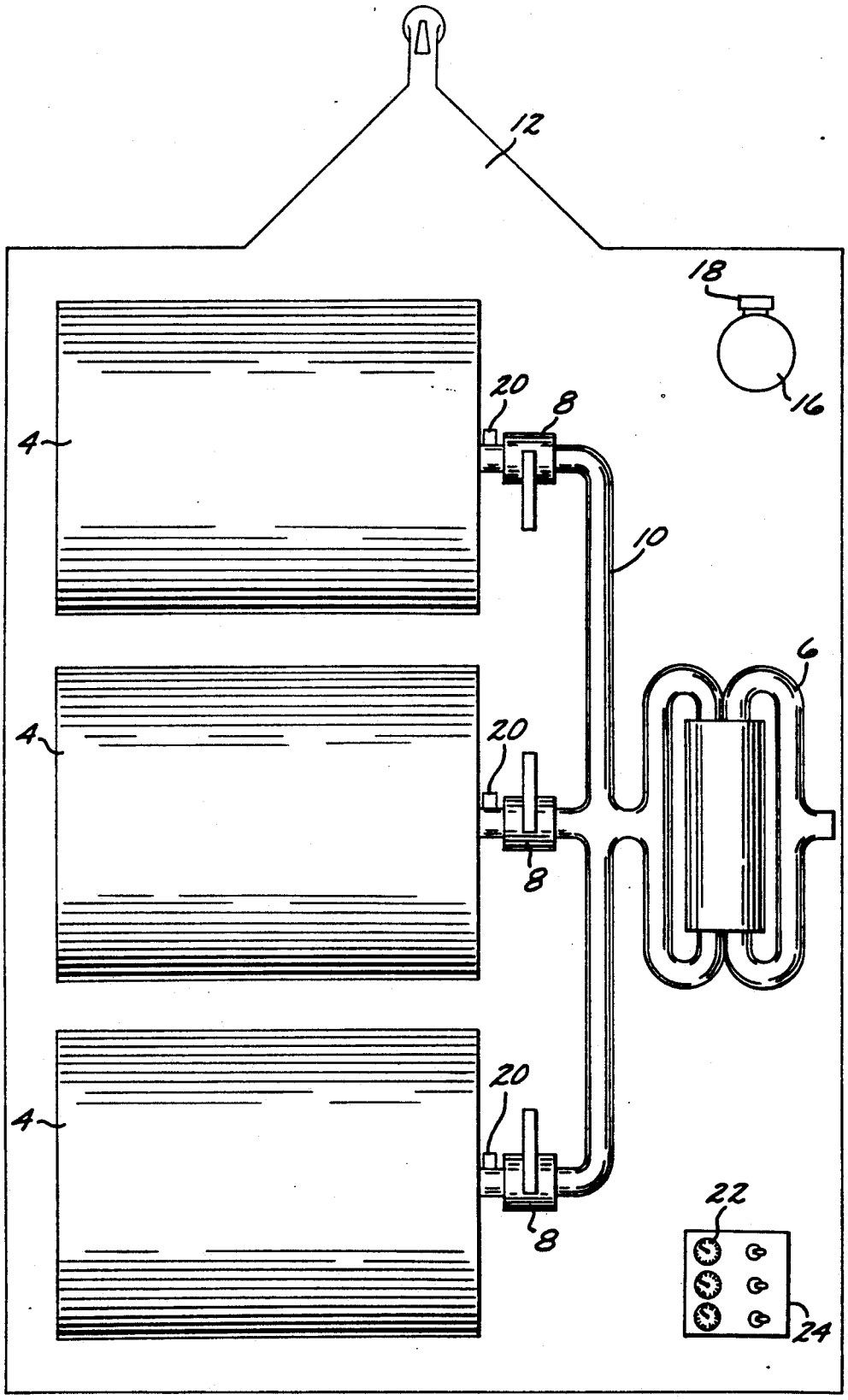
FIG. 1 shows a multi-tank, trailer mounted, apparatus from above.
Figure 4:
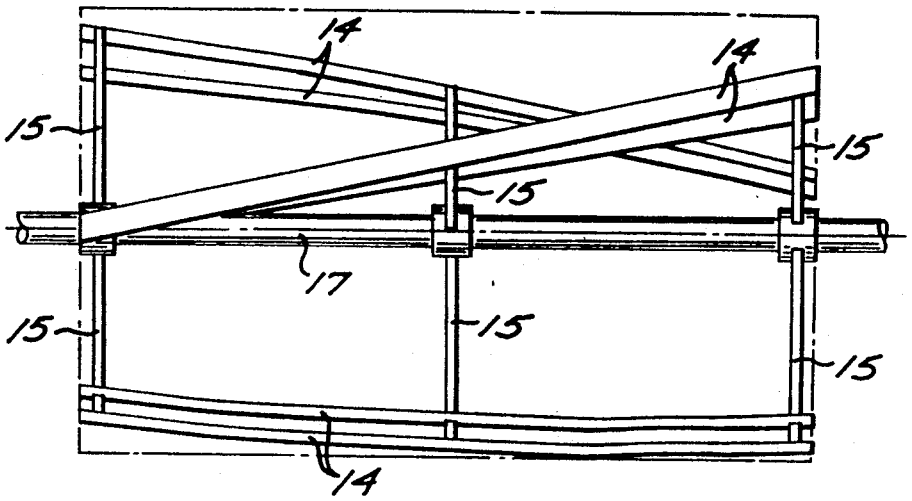
FIG. 4 shows a side view of the blades attached to the axle running through the center of the tank.
Figure 3:
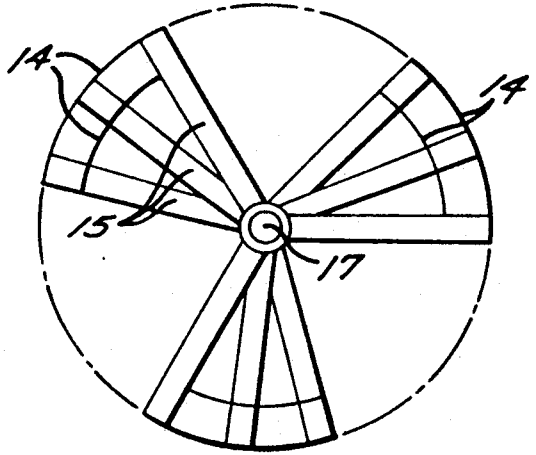
FIG. 3 shows an end view of the three blade configuration used for mixing.
Figure 5:
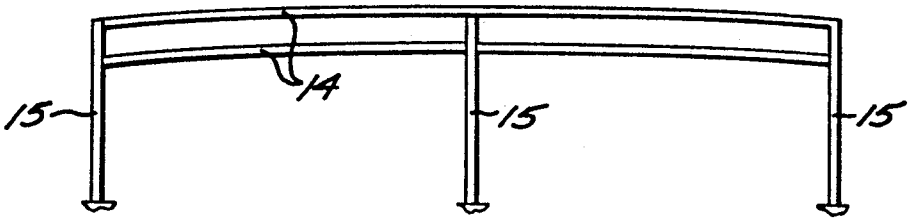
FIG. 5 shows the shape of a single blade in more detail.

A preferred embodiment of the apparatus of the present invention is illustrated in FIG. 1, consisting of multiple tanks 4 with a single pump 6. Each tank can be accessed through a top loading opening 2 through which premeasured amounts of water, emulsion and cement are added. The tanks 4 are connected in tandom to a common pneumatic diaphragm pump 6 via a valved 8 manifold 10. The manifold 10 allows mixed slurry to be pumped from a single mixing tank or from multiple tanks at one time using a single pump 6. In this manner, staggered batches of cellular concrete can be pumped sequentially to provide a continuous flow of slurry. The array of tanks, manifold, and pump are mounted on a mobile trailer platform 12. Specially designed blades 14, FIGS. 3, 4, and 5, limit overfoaming and provide for the optimum in strength and insulation of the product.

The design of the blades consists of only three sets. Each set is made with two simple, flat steel ribbons. Each set of blades 14 is held in position by a plurality of arms 15 extending radially outwardly from the center axis 17 about which the blades are rotatable. The length of each set of blades is slightly angled relative the axis 17 in order to define about a 45° section of spiral. Most importantly, the width of each blade is oriented so as to be aligned with the direction of travel and thereby minimize turbulence. They have no wings, or special angle as in the previous art. They follow along the tank in a spiral fashion with both edges equally spaced from the tank. This change in design has rectified the problem of overfoaming, allowing for a better quality product.

The blades 14 are driven by electric, pneumatic, or internal combustion motor(s). The apparatus is controlled manually allowing for: 1. easy variation of speed and duration of mixing, 2. use with multiple emulsion and cement formulations, 3. lower equipment costs, 4. reduced space requirements, and 5. easy trailerability of the apparatus.

Figure 2:
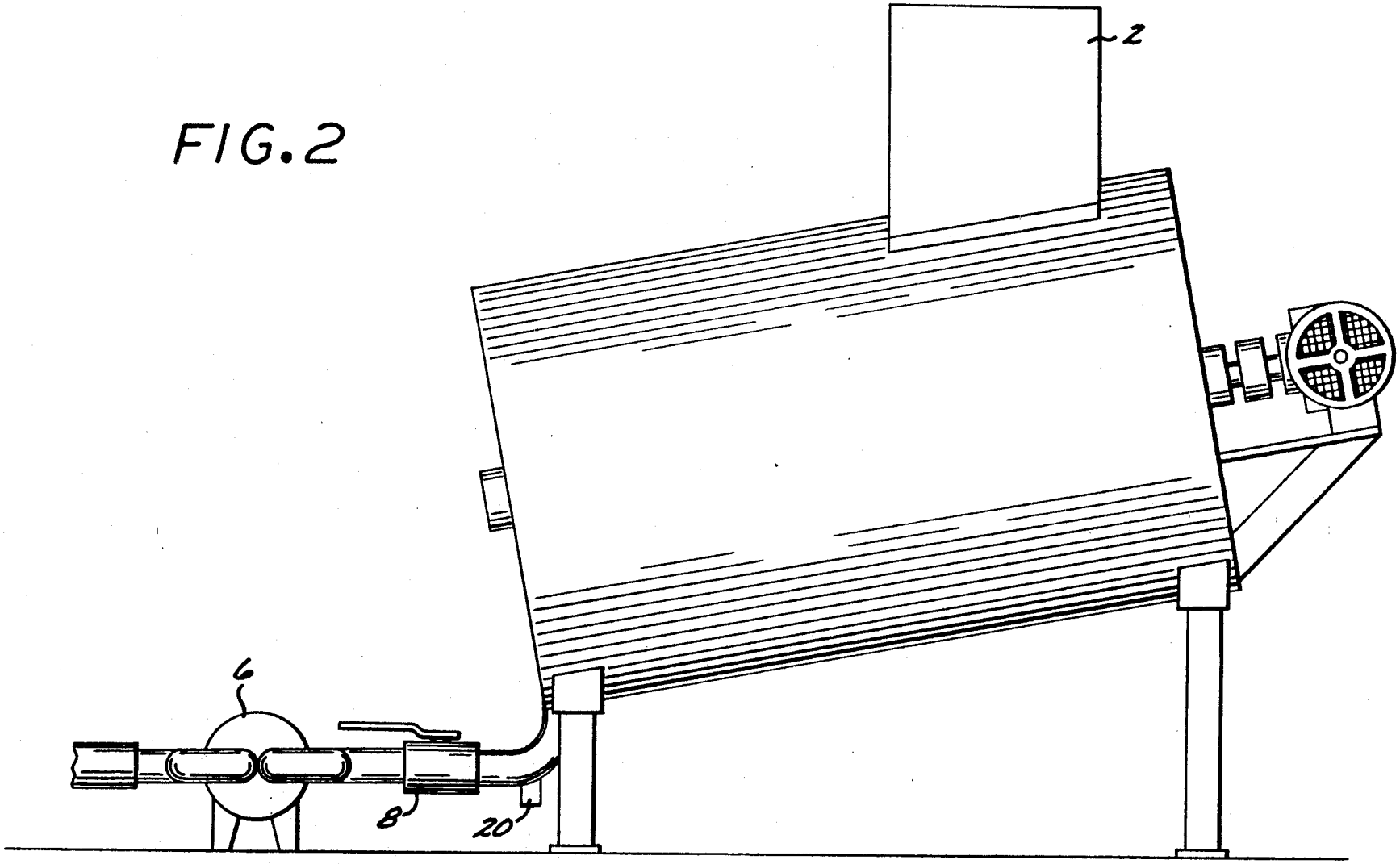
FIG. 2 shows a side view of a single tank unit. It shows the location of the bleeder valve and the on-off valve to allow flow of the slurry through the pump.

Aspects of this invention allow for the apparatus to be constructed with one (FIG. 2) or multiple mixing tanks (FIG. 1), incorporate a water heating device 16 (FIG. 1), a modified blade design (FIGS. 3, 4, and 5), a bleeder valve 20 (FIG. 2) to control the consistency of the foam, and a self contained power source, as needed. The apparatus as described offers significant improvements over existing technology in versatility, quality of concrete product produced, and economy.

OPERATION

To use the apparatus is quite simple. First water is premeasured into the tank. The stirring mechanism is started with the on-off switch 24 corresponding to the tank being used. Then emulsion A, which has been packaged in premeasured quantities, is poured into the tank. Aggitation continues until all of the water is whipped into the foam. Each new site can have different water hardness which will affect the time needed for making the right consistency of foam. Therefore, the bleeder valve 20 can be used to check for water not yet whipped into the foam. Once the time is established at the new site, you can use the timer switch 22 to control the mixing time. Then the cement mixture (powder) is added, aggitated, and lastly the premeasured emulsion B is added and aggitated. It is then ready to be pumped out through the manifold 10 and pump 6 into a hose that carries it to the desired place (forms).

While the first tank is mixing foam, the next tank can be filled and started etc. Each tank can be individually pumped out, or multiple tanks can be pumping at the same time. By staggering the mixing and pumping, a continuous flow of concrete can be achieved. This is important when doing large jobs. If the weather is cold, and the water is colder than approximately 14° C. (57° F.), it is desirable to use a demand water heater 16 through which the water may flow by connecting a hose to the screw mount 18 on the hot water heater. Thus the water can be preheated to the desired temperature (14 to 20° C. or 57 to 68° F.) for proper hypdrolization.

SUMMARY, RAMIFICATIONS, AND SCOPE

Accordingly, the reader will see that the invention apparatus can be used to make a cellular concrete which offers significant improvements over existing technology. These improvements lie in the areas of versatility, quality of concrete produced, and economy. The advantages of this simplified machine makes it possible to produce a superior quality of cellular concrete which 51% lighter for approximately the same allowable bending strength as the control example. The multiple tank unit allows for a continuous flow of concrete. The modified blade configuration prevents overfoaming, giving higher strength concrete. The bleeder valve allows checking of the consistency of the foam during mixing. The water heater provides for use in below freezing weather. In addition, the apparatus can easily be pulled by a pickup truck to the construction site.

The simplicity of the unit along with the premeasured packaging of emulsions allows anyone to have the ability to use the apparatus and allows even the small contractor to have the possibility of owning such an apparatus.

Although the description above contains many specificities, these should not be construed as limiting the scope of the invention but as merely providing illustrations of some of the presently preferred embodiments of this invention. For example, the apparatus can be built in various sizes to make yards or meters. Another variant would be to use the apparatus as a stationary unit in a warehouse setting rather than have it mounted on a trailer platform.

Thus the scope of the invention should be determined by the appended claims and their legal equivalents, rather than by the examples given.

We claim:

1. An apparatus for mixing high strength, light weight cellular concrete, comprising:

a tank for containing constituents of said concrete;

blades, rotatable about a central axis within said tank for agitating said constituents yet limiting overfoaming, each of said blades comprising an elongated flat and band disposed equidistantly from and arranged substantially along said axis of rotation and wherein each said blade's wide dimension is oriented in parallel to the direction of rotation; and means for rotating said blades.

2. The apparatus of claim 1 wherein each of said blades is slightly spiraled about said axis of rotation.

3. The apparatus of claim 2 wherein three sets of blades are uniformly distributed for rotation about said central axis and wherein each set of blades comprises two tandemly arranged blades, one being radially spaced relative the other.

4. The apparatus of claim 1 wherein a bleeder valve is disposed near the base of said tank for sampling said constituents during agitation.

5. The apparatus of claim 1 wherein the plurality of said tanks having said blades therein are interconnected via a valved manifold whereby continuous output of mixed cellular concrete can be provided.

6. The apparatus of claim 1 further comprising a water heater for heating water introduced into said tank whereby concrete mixing can be continued during cold ambient temperature.

7. The apparatus of claim 1 wherein said agitation means provides for variability of mixing speed.

* * * * *